US005781163A

United States Patent [19]

Ricardi et al.

[11] Patent Number: 5,781,163

[45] Date of Patent: Jul. 14, 1998

[54] LOW PROFILE HEMISPHERICAL LENS ANTENNA ARRAY ON A GROUND PLANE

[75] Inventors: Leon J. Ricardi, El Segundo; Francis W. Cipolla, Newbury Park, both of Calif.

[73] Assignee: Datron/Transco, Inc., Simi Valley, Calif.

[21] Appl. No.: 761,284

[22] Filed: Dec. 6, 1996

Related U.S. Application Data

[60] Provisional application No. 60/002,868 Aug. 28, 1995.

Related U.S. Application Data

[63] Continuation-in-part of Ser. No. 700,231, Aug. 20, 1996.

[51] Int. Cl.[6] ..... H01Q 15/08

[52] U.S. Cl. ..... 343/911 R; 343/911 L; 343/754; 343/755

[58] Field of Search ..... 343/753, 754, 343/755, 757, 758, 911 L, 911 R

[56] References Cited

U.S. PATENT DOCUMENTS

| | | | |
|---|---|---|---|
| 3,386,099 | 5/1968 | Walter et al. | 343/754 |
| 3,972,043 | 7/1976 | Locus | 343/911 L |
| 4,001,835 | 1/1977 | Dover et al. | 343/754 |
| 4,531,129 | 7/1985 | Bonebright et al. | 343/754 |
| 4,642,651 | 2/1987 | Kuhn | 343/754 |
| 4,755,820 | 7/1988 | Backhouse et al. | 343/753 |
| 5,185,613 | 2/1993 | Whatmore et al. | 343/753 |
| 5,528,254 | 6/1996 | Howng et al. | 343/753 |
| 5,625,368 | 4/1997 | Howson et al. | 343/753 |

*Primary Examiner*—Hoanganh T. Le
*Assistant Examiner*—Tan Ho

[57] ABSTRACT

An array of hemispherical dielectric lenses antenna on a ground plane for focusing radiation from an array of point sources, each point source being located adjacent to its respective hemispherical lens. Dual polarization point sources provide dual orthogonally polarized radiation patterns, including right and left hand circularly polarized radiation patterns. The entire antenna and ground plane may be rotated and the array of point sources may be moved relative to the hemispherical lenses so as to scan the antenna beam over a hemisphere.

12 Claims, 2 Drawing Sheets

LOW PROFILE HEMISPHERICAL LENS ANTENNA ARRAY ON A GROUND PLANE

Figure 1:
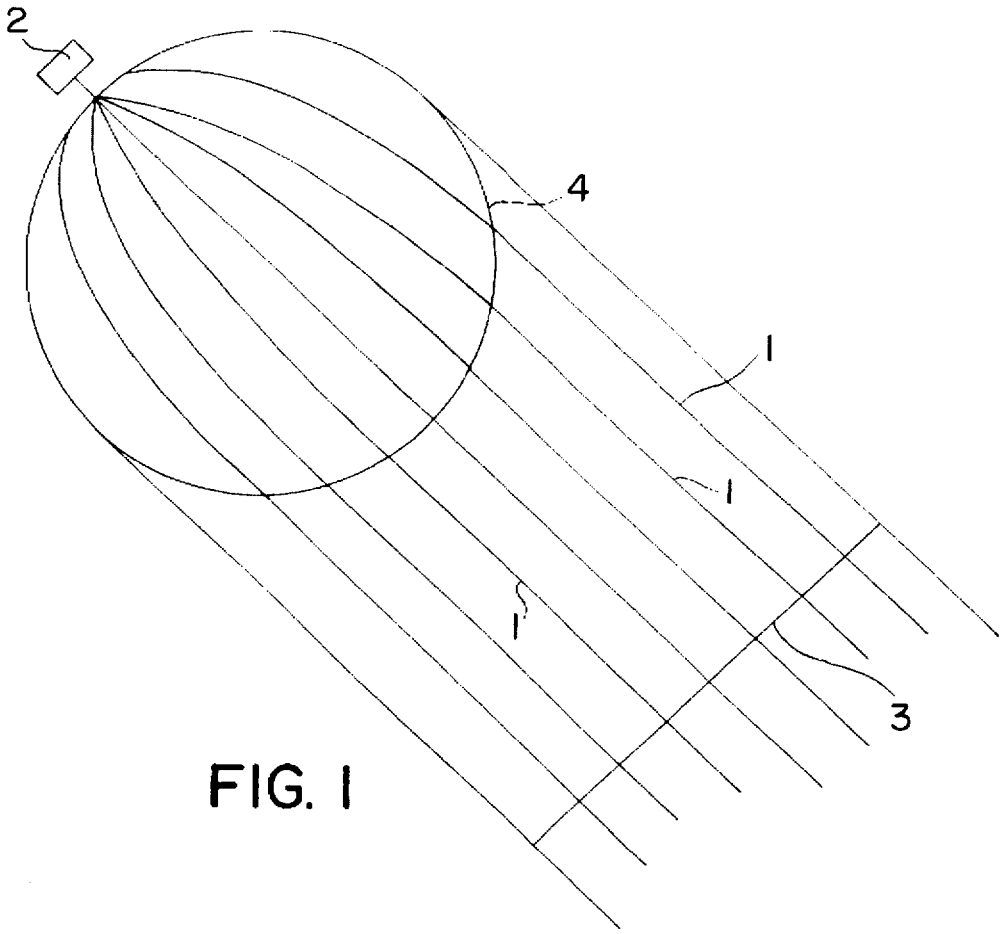

This application is a continuation-in-part of application Ser. No. 08/700,231, titled "Low Profile Semi-Cylindrical Lens Antenna on a Ground Plane," filed Aug. 20, 1996, which application claims the benefit of U.S. Provisional Application No. 60/002,868, filed Aug. 28, 1995 and titled "A Low Profile Lens Antenna".

1. BACKGROUND OF THE INVENTION a. Field of the Invention

This invention pertains to microwave antennas. More particularly this invention pertains to microwave scanning lens antennas.

b. Description of the Prior Art

Microwave antennas that utilize a spherical dielectric lens are well known in the art. See e.g. Braun, E. H., "Radiation Characteristics of Spherical Luneberg Lens," *IRE Transactions on Antennas and Propagation*, April 1956, pages 132–138; Kay, A. F., "Spherically Symmetric Lenses," *IRE Transactions on Antennas and Propagation*, January 1959, pages 32–38; Luneberg, R. K., *Mathematical Theory of Optics*, Brown University, Providence, R.I., 1944, pages 189 to 213; Morgan, S. P., "General Solution of the Luneberg Lens Problem," *Journal of Applied Physics*, September 1958, pages 1358–1368; Morgan, S. P., "Generalizations of Spherically Symmetric Lenses," *IRE Transactions on Antennas and Propagation*, October 1959, pages 342–345; Peeler, G. D. M., and H. P. Coleman, "Microwave Stepped-Index Luneberg Lenses," *IRE Transactions on Antennas and Propagation*, April 1958, pages 202–207; "Luneberg and Einstein Lenses", Sec. 14-10, Antennas, J. Kraus, McGraw-Hill Book Company, 2nd. Ed., pp. 688–690; "The Geodesic Luneberg Lens" by Richard C. Johnson, *The Microwave Journal*, Aug. 1962, pp. 76–85.

A microwave lens antenna that utilizes a lens comprising one-half of a dielectric sphere (a "semi-sphere") mounted upon a ground plane, where the reflection from the ground plane, in effect, provides the second half of the dielectric sphere is also known in the prior art. See e.g. "Lenses for Direction of Radiation", Sec. 12.19, Fields and Waves in Communication Electronics, Ramo, Whinnery, and Van Duzen, John Wiley & Sons, pp. 676–678. A microwave lens antenna that utilizes an array of hemispherical lens, however, is not known in the prior art.

2. SUMMARY OF THE INVENTION

The present invention utilizes dielectric lenses in the form of an array of hemispherical lens mounted on a ground plane to focus into a pencil or fan beam the energy radiated from an array of point sources located near the surfaces of the hemispheres. When mounted upon the fuselage of an aircraft, the lens array has an advantage over a single sphere in free space in that each hemispherical lens extends only one-half as far outside of the fuselage and into the airstream as compared to a complete spherical lens. Furthermore, because the antenna consists of an array of hemispheres instead of a single hemisphere having the same gain as the array of hemispheres, the array of hemispheres protrudes outside of the fuselage a lesser amount than would the single hemisphere having the same gain. For these reasons, the hemispherical lens array is a "low-profile" antenna.

It should be understood that, although for simplicity of description, the invention may be described as radiating electromagnetic energy, the invention may also be used for the reception of electromagnetic energy or for both the reception and radiation of energy.

3. BRIEF DESCRIPTION OF THE DRAWINGS

Figure 2:
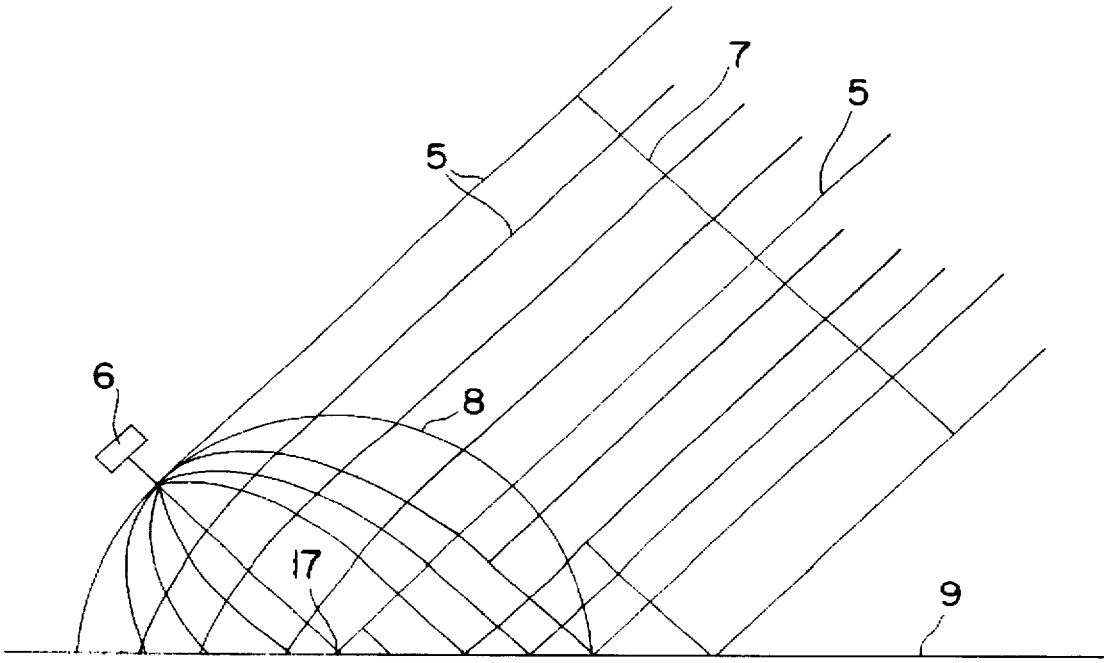
Figure 3:
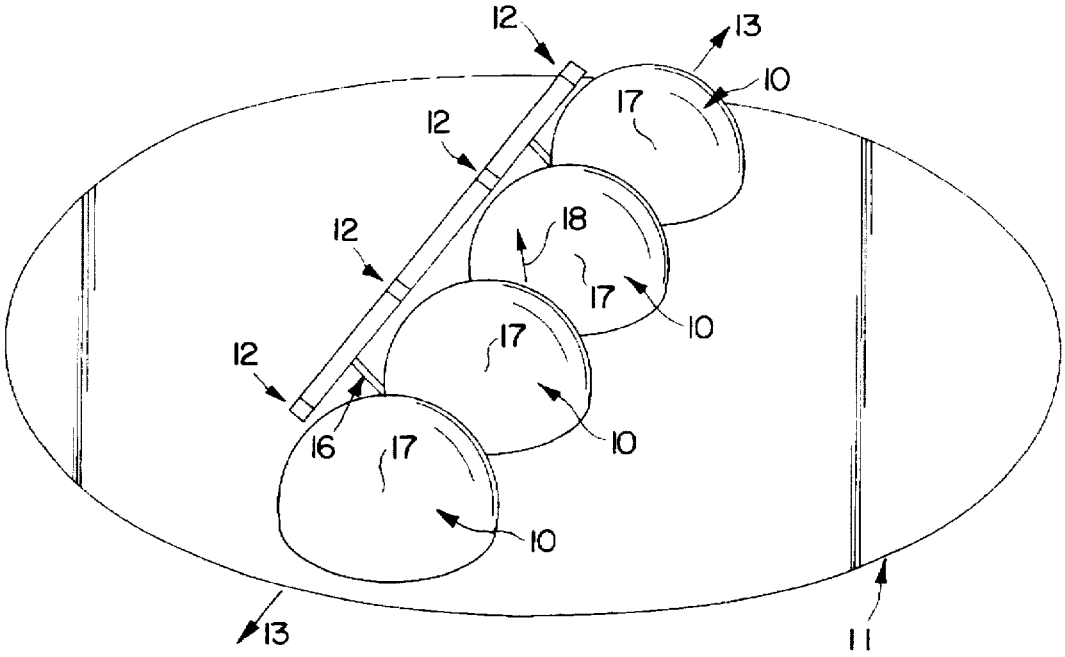
Figure 4:
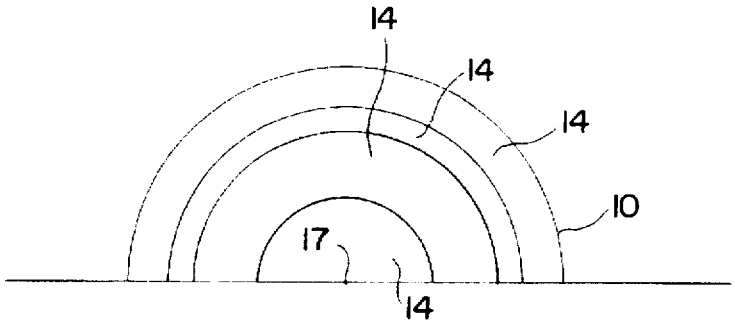

FIG. 1 depicts a cross-sectional view of the paths of rays emanating from a point source that are focused into a plane wave by a spherical lens. FIG. 2 depicts a cross-sectional view of the paths of rays emanating from a point source that are focused into a plane wave by a hemispherical lens mounted on a ground plane. FIG. 3 is a pictorial view of a linear array of hemispherical lenses on a ground plane. FIG. 4 is a cross-sectional view of one hemispherical lens fabricated from concentric dielectric hemispheres having "stepped" dielectric constants.

4. DETAILED DESCRIPTION

FIG. 1 depicts a cross-sectional view of the paths of rays 1 emanating from a point source 2 that are focused into a plane wave 3 by a spherical lens 4. FIG. 2 depicts a cross-sectional view of the paths of rays 5 emanating from a point source 6 that are focused into a plane wave 7 by a hemispherical lens 8 having a center 17 and being mounted upon a ground plane 9. As indicated in FIG. 2, the rays 5 emanating from point source 6 and passing through lens 8 are reflected by ground plane 9. Depending upon the location of rays 5 relative to hemispherical lens 8 and ground plane 9, after reflection by ground plane 9 the rays may or may not pass through a further portion of lens 8. As may be seen from FIGS. 1 and 2, except for a change in direction, the plane wave depicted in FIG. 2 that is formed by hemispherical lens 8 and ground plane 9 has the same form as the plane wave depicted in FIG. 1 that is formed by spherical lens 4.

Referring to FIG. 3, the present invention uses a plurality of hemispherical, dielectric lenses 10, each lens having the general shape of one-half of a sphere, i.e. a "hemisphere", that are mounted on ground plane 11 so as to form a linear array of lenses that focuses the radiation pattern from the array of point sources 12 into a beam. The center 17 of each lens is located along the axis 13 of the array. Ground plane 11 reflect the energy incident thereon and by the reflection, in effect, provides a second one-half sphere to each of the dielectric hemispheres in the array so that the combination of the hemispherical lenses and the ground plane together give the effect of an array of spherical lens. Although the beam generated by the array of hemispherical lenses may be in the form of a "pencil" beam or a "fan" shaped beam, it should be understood that actual shape of the beam generated by the array will depend upon the relative dimensions of the hemispherical lenses, the number of lenses and point sources, the spacing of the lenses in the array and the the manner in which the lenses are illuminated by the array of point sources.

It should also be understood that although FIG. 3 depicts a linear array of hemispheres, this invention can comprise an array of hemispheres in other than a linear array, e.g. a rectangular array. In such a rectangular array, the beam generated by the array would be scanned in space by moving in synchronism the point sources associated with the respective hemispheres. Accordingly, the term "array" should be understood to include not only a linear array, but to include any other geometrical arrangement of hemispheres on a ground plane.

For a classical Luneberg Lens, the variation of the relative dielectric constant, $e_r$ for lens 10 would vary as a function of radial distance, r, from the center 17 of the lens according the the formula:

$$e_r=2-(2r/D)^2 \quad (1)$$

where D is the diameter of the hemispherical lens. However, as indicated in FIG. 4, in the preferred embodiment, each of the dielectric lenses 10 consists of a series of concentric dielectric hemispherical layers 14, with each dielectric hemispherical layer having a constant, but different dielectric constant so that the dielectric properties of the lens will be spherically symmetric (over a half-space) about the center 17 of lens 10. The "stepped" dielectrics provide an approximation to a lens having a continuously varying dielectric constant and simplify the fabrication of the antenna. As an example, in one embodiment of the invention that approximates a Luneberg lens, each hemispherical lens may consist of four dielectric hemispheres made of polystyrene beads which have stepped relative dielectric constants and relative radial dimensions given as follows:

| radius | relative dielectric constant |
|---|---|
| 0–1.106 | 1.942 |
| 1.107–1.900 | 1.654 |
| 1.901–2.250 | 1.46 |
| 2.251–2.7 | 1.332 |

It should be understood, however, that a different number of dielectric steps could, instead, be used and that different values of dielectric constants could be used to approximate a Luneberg lens and, of course, that a dielectric material having a dielectric constant that varies continuously as a function of the radial distance from the center of the hemisphere could be used to form each lens. Furthermore, artificial dielectrics, such as distributed, small spherical conductors, could be used to provide, in effect, a media having a variable dielectric constant. Accordingly, the term "dielectric" should be understood to encompass all means for providing a relative dielectric constant differing from that of free space.

Although in the preferred embodiment the stepped dielectric is used to approximate the dielectric properties of a Luneberg lens, it should be understood that other types of lenses such as a "constant K" lenses could be used to focus the radiation from the point sources into a beam. It should also be understood that although the dielectric constant of each lens in the embodiment described above varies with radial distance from the center of the lens in an approximation to the "classical" manner described in equation (1) above, other embodiments could use dielectrics which vary in a different manner as a function of radial distance from the center of each hemisphere. Typically, such "non-classical" distributions would provide broader beams and less gain than would be provided by the classical distribution.

Each of the hemispherical lenses 10 is "illuminated" (or "fed") by an elemental radiating source such as a horn, dipole, patch, slot, etc. The signals received from the respective hemispherical lenses by the elements of the array of point sources can be combined, in phase, to produce a "sum" pattern, which sum pattern may be used for the transmission or reception of data. The signals received from one-half of the lenses could also be combined in anti-phase with the signals received from the second half of the lenses to produce a "difference" pattern which difference pattern may be used for tracking purposes.

The array of point sources 12 is supported by boom 16 and arms 18 so as to position each source adjacent to its respective hemispherical lens. Arms 18 are hinged at axis 13 so that boom 16 may be rotated about array axis 13 so as to cause the beam generated by the array of hemispherical lenses also to rotate about axis 13.

Referring again to FIG. 3, point sources 12 are depicted as being located very near to the surfaces of dielectric hemispherical lenses 10. In the preferred embodiment the spacings between point sources 12 and the surfaces of lenses 10 are adjusted so as to cause lenses 10 to focus the radiation from point sources 12 at infinity so as to generate a plane wave. The actual spacing is dependent upon the effective dielectric properties of the "stepped" lenses and upon the effective phase centers of the point sources, i.e. upon the locations in space from which the radiation from the each point source appears to emanate. Because each hemispherical lens in the preferred embodiment is approximated by the stepped values of dielectric material that include an outermost "step" that has a relative dielectric constant of 1, i.e. in which there is no polystyrene, each point source is offset somewhat from the actual surface of the outermost hemispherical layer of dielectric in its respective hemispherical lens. It should also be understood that in some applications, a spacing may be used that provides a focus at some distance other than at infinite.

The polarization of the far-field for the array of hemispherical lenses is essentially the same as the polarization of each point source. Accordingly, if a dual, orthogonally polarized horn (or crossed dipoles) is used to feed each hemispherical lens, then the far-field would have dual orthogonal polarization. As a consequence such dual orthogonally polarized point sources can be used to provide dual, orthogonally polarized far-fields, which fields can be linearly, circularly or elliptically polarized.

If point sources 12 consist of two independent arrays of point sources having differing polarizations, e.g. one array of point sources having linear polarization aligned with axis 13 of the array and a second array of point sources having linear polarization oriented orthogonally to axis 13, then the two arrays of point sources can be used independently to obtain differing far-field radiation polarizations, e.g. simultaneous right-hand circularly polarized radiation and left-hand circularly polarized radiation.

In the preferred embodiment, ground plane 11 is rotatably mounted about its central axis 18 so that in applications where the ground plane is oriented approximately parallel to the surface of the earth, the beam generated by the lens may be scanned 360 degrees in azimuth by rotation of the ground plane about axis 18 and may be scanned from near the horizon to a near vertical position by moving the array of point sources through a range of approximately 90 degrees, i.e. from a position adjacent to the ground plane to a position atop the dielectric lenses. In the preferred embodiment the array of point sources is moved through an angular range of less than 90 degrees and always remains on one side of the array of lenses and the beam from the array of lenses is always directed to the other side of the array, i.e. to the side of the array opposite to the array of point sources.

We claim:

1. An antenna comprising, a ground plane having an upper surface, a plurality of hemispherical lenses forming an array, each hemispherical lens having a flat side coincident with the center of the hemisphere, said flat side of each hemispherical lens being substantially adjacent to the upper surface of the ground plane, a plurality of point sources, each hemispherical lens having one of the point sources located outside of the hemispherical lens and in proximity to the hemispherical surface of the lens, each point source being afixed in a hinging manner about an axis located at the center of its proximate hemispherical lens, and having the same spacial positioning relative to its proximate hemispherical lens as all of the other points sources have with respect to their respective proximate hemispherical lenses, said hinging axis being parallel to and approximately coincident with the upper surface of the ground plane.

2. The antenna of claim 1 wherein the plurality of hemispherical lenses forms a linear array having a lens array axis wherein the centers of the hemispherical lenses coincide approximately with the lens array axis, and wherein the plurality of point sources form a linear array of line sources, the linear array of line sources being afixed in a hinging manner about the lens array axis.

3. The antenna of claim 2 wherein the entire antenna is rotatably mounted about an axis passing through the ground plane.

4. The antenna of claim 1 wherein each hemispherical lens comprises a dielectric.

5. The antenna of claim 4 wherein each hemispherical lens comprises a dielectric having a relative dielectric constant that varies as a function of radial distance from the center of the hemispherical lens.

6. The antenna of claim 5 wherein the relative dielectric constant of each hemispherical lens varies approximately in accord with the equation $e_r=2-(2*r/D)^2$, where "D" is equal to the diameter of the hemispherical lens and r is the radial distance from the center of the hemispherical lens.

7. The antenna of claim 5 wherein the entire antenna is rotatably mounted about an axis passing through the ground plane.

8. The antenna of claim 6 wherein the entire antenna is rotatably mounted about an axis passing through the ground plane.

9. The antenna of claim 4 wherein the entire antenna is rotatably mounted about an axis passing through the ground plane.

10. The antenna of claim 1 wherein the plurality of point sources are dual polarized.

11. The antenna of claim 10 wherein the entire antenna is rotatably mounted about an axis passing through the ground plane.

12. The antenna of claim 1 wherein the entire antenna is rotatably mounted about an axis passing through the ground plane.

* * * * *